United States Patent [19]

Mead

[11] Patent Number: 4,796,461

[45] Date of Patent: Jan. 10, 1989

[54] HYDRAULIC CRIMPING TOOL

[75] Inventor: Howard Mead, Loves Park, Ill.

[73] Assignee: Greenlee Textron Inc., Rockford, Ill.

[21] Appl. No.: 869,625

[22] Filed: Jun. 2, 1986

[51] Int. Cl.[4] ..... B21J 9/12

[52] U.S. Cl. ..... 72/453.16; 72/453.02; 72/410; 60/479; 91/396

[58] Field of Search ..... 72/453.02, 453.15, 453.16, 72/452, 410; 91/395, 396, 405; 60/479; 81/301

[56] References Cited

U.S. PATENT DOCUMENTS

| | | | |
|---|---|---|---|
| 4,132,107 | 1/1979 | Suganuma et al. | 72/453.16 |
| 4,136,549 | 1/1979 | Lytle et al. | 72/453.16 |
| 4,309,936 | 1/1982 | Eberle et al. | 91/405 |
| 4,337,635 | 7/1982 | Martin et al. | 72/453.16 |
| 4,342,216 | 8/1982 | Gregory | 72/410 |
| 4,480,460 | 11/1984 | Bush et al. | 72/452 |
| 4,604,890 | 8/1986 | Martin | 72/410 |

FOREIGN PATENT DOCUMENTS

| | | | |
|---|---|---|---|
| 699348 | 11/1953 | United Kingdom | 91/395 |

*Primary Examiner*—David Jones

*Attorney, Agent, or Firm*—Lackenbach Siegel Marzullo & Aronson

[57] ABSTRACT

The hydraulic crimping tool includes a piston follower mechanism to provide an automatically sequentially reduced crimping force and extent of crimping deformation in predetermined manner in dependence on the extent of travel of a movable crimping jaw toward a stationary jaw.

10 Claims, 4 Drawing Sheets

HYDRAULIC CRIMPING TOOL

FIELD OF THE INVENTION

The invention relates to hydraulic force applying tools and, in particular, hydraulic crimping tools.

BACKGROUND OF THE INVENTION

A number of hydraulic crimping tools have been developed for crimping or compressing metal connectors about electrical cable to form an electrical and structural connection between two conductors, or between a conductor and a terminal.

There are currently many types and sizes of electrical connectors in use. One type commonly used is a tubular cylindrical connector commonly referred to as a sleeve connector which will connect two conductors or cables together in a straight line. A variation of this type for connection to the end of the cable includes the tubular cylindrical sleeve having a flat portion for connection of the cable to a terminal. Other connector configurations are also used as is known in the art.

Prior art workers have used various hydraulic crimping tool constructions to compress the sleeve and other electrical connections in use. Various constructions are illustrated in the following:

U.S. Pat. No. 4,480,460 issued Nov. 6, 1984 to Bush et al

U.S. Pat. No. 4,342,216 issued Aug. 3, 1982 to Gregory

U.S. Pat. No. 4,337,635 issued July 6, 1982 to Martin et al

U.S. Pat. No. 4,136,549 issued Jan. 30, 1979 to Lytle et al

U.S. Pat. No. 4,132,107 issued Jan. 2, 1979 to Suganuma et al.

U.S. Pat. No. 4,019,362 issued Apr. 26, 1977 to McKeever

U.S. Pat. No. 2,688,231 issued Sept. 7, 1954 to Northcutt

U.S. Pat. No. 2,567,155 issued Sept. 5, 1951 to Macy

To accommodate different types or sizes of electrical connectors, the Bush et al U.S. Pat. No. 4,480,460 employs crimping arms which are movable to different positions on the tool head. To this same end, the Martin et al U.S. Pat. No. 4,337,635 employs means on the tool for locating each of a plurality of compression surfaces in different locations in a manner to provide increased compression from one end of the tool head toward an opposite end. The Lytle U.S. Pat. No. 4,136,549 employs differential thread mechanisms on the tool to this same end.

The Gregory U.S. Pat. No. 4,342,216 includes a transfer check valve in a hydraulic crimper with the check valve being liftable from its seat to limit the stroke of the crimping ram to permit the operator to press a button to relieve fluid pressure in the tool.

SUMMARY OF THE INVENTION

The present invention contemplates a hydraulic force delivering tool, such as a crimping tool for electrical connectors, having piston follower means for automatically regulating applied force in dependence upon the amount of travel of the force applying piston.

The present invention also contemplates a hydraulic force applying tool of the type just described in which the applied force is automatically decreased in a predetermined sequence as piston travels changes so as to control, in one particular embodiment involving crimping of an electrical connector, the crimping force and extent of crimp deformation for a particular electrical connector in dependence on travel of the piston.

In a typical working embodiment of the invention, a hydraulic crimping tool includes a follower rod movable with the piston ram and having multiple followed stepped surfaces or an inclined surface which actuate a slide mechanism controlling (reducing) spring bias on a relief valve depending upon the position of the force applying piston to allow unseating of the relief valve at selected incremental lower hydraulic pressures to provide a reduced crimping force and extent of crimping deformation in a selected increment depending upon piston travel. Piston travel and the location and length of steps of the follower rod are predetermined based upon the extent to which different sizes of electrical connectors will be crimped to provide decreased final crimping force and deformation to individualized levels for each size or range of sizes of electrical connectors.

DESCRIPTION OF PREFERRED EMBODIMENTS

Figure 1:
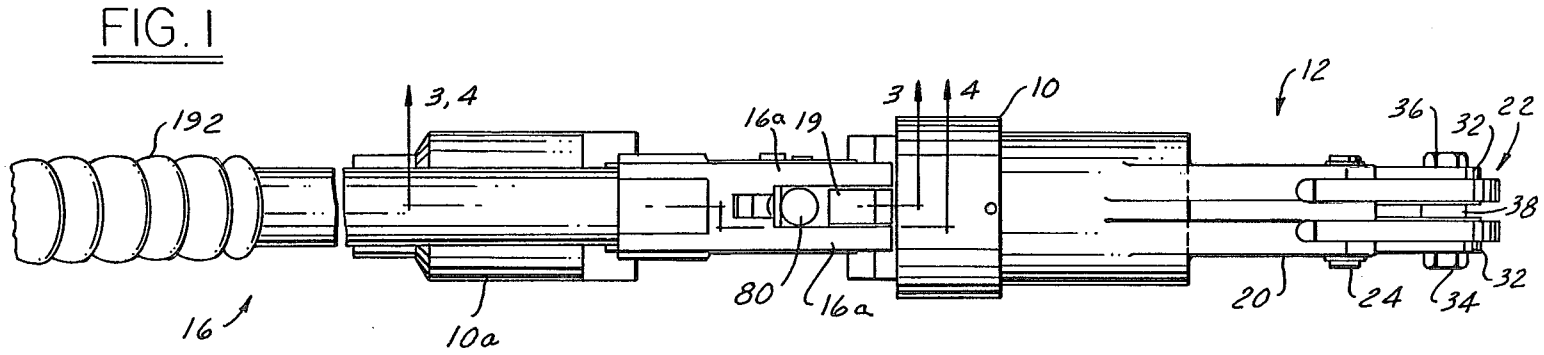
FIG. 1 is a plan view of the crimping tool of the invention.
Figure 2:
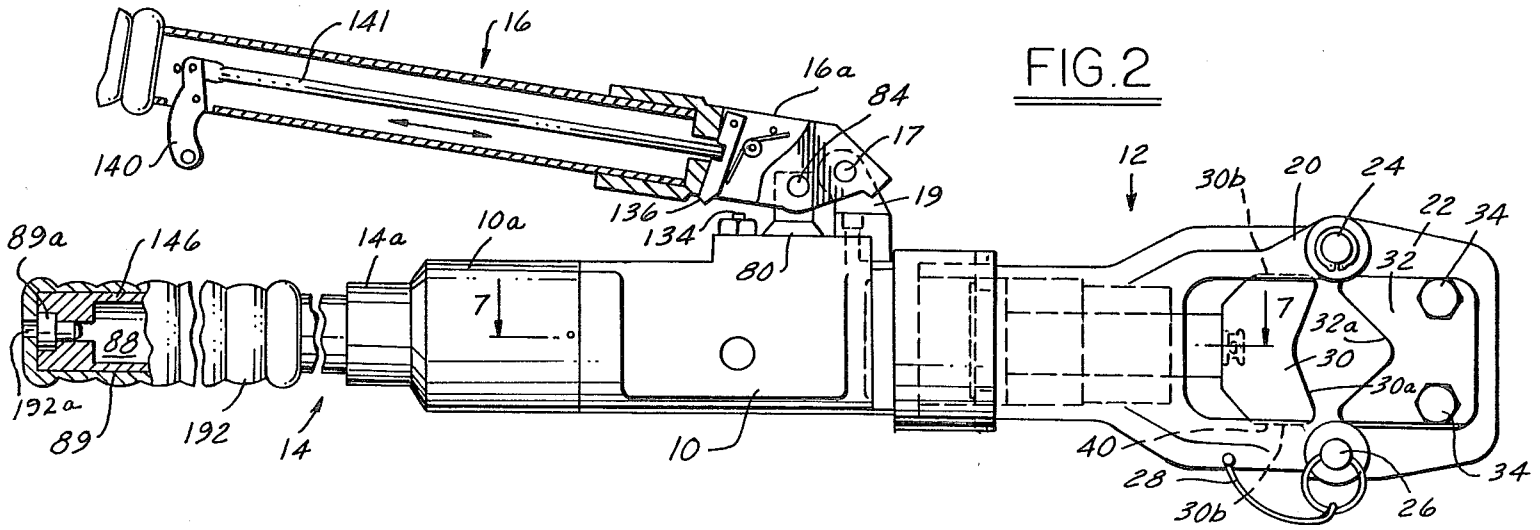
FIG. 2 is an elevation of the crimping tool of FIG. 1.

FIGS. 1 and 2 illustrate a crimping tool constructed in accordance with the invention as having a main body 10 including a tool head portion 12 and fixed handle portion 14 and further having a manually-operable moving handle 16 with yoke **16*a* pivotally mounted by pin 17 on support 19 extending from body 10**.

The tool head portion 12 of the main body 10 includes a fixed U-shaped housing 20 fixedly attached on the main body and a hinged U-shaped housing 22 hinged by pin 24 to the fixed U-shaped housing. A releasable connector pin 26 releasably connects the U-shaped housings 20,22 on the side opposite from the hinge pin 24. A wire 28 attaches the connector pin 26 to the fixed U-shaped housing 20. It is apparent that removal of connector pin 26 will allow U-shaped housing 22 to be swung open about hinge pin 24 to change the crimping jaws 30,32 described below as well as to allow jaws 30,32 to be positioned around a connector overlying two conductors for splicing same together regardless of their lengths.

The crimping jaws 32 comprise two or more stacked spaced apart jaws 32 bolted together and to U-shaped housing 22 by machine screws 34 and nuts 36 and spaced apart by spacer 38. Jaws 32 are thus fixed in position and not movable during the crimping operation. Jaws 32 each have a crimping or working face **32*a* which, together with the crimping or working face 30*a* of movable jaws 30**, form a polygonal shaped recess in which the electrical connector (not shown) is compressed.

Movable jaw 30 includes lateral edges 30*b* which move in and are guided in slots 40 in the fixed U-shaped housing 20 as the movable jaw is moved toward and away from the fixed jaws 32. The movable jaw is a unitary structure, FIG. 7, having three spaced apart crimping or working surfaces 30*a* between which are disposed slots 30*b* to receive the crimping or working surfaces 32*a* of the fixed jaw 32. As is apparent, the crimping surfaces 30*a* together with crimping surfaces 32*a* form the aforementioned polygonal shaped recess when nested to receive the electrical connector and cable in known prior art manner.

Figure 7:
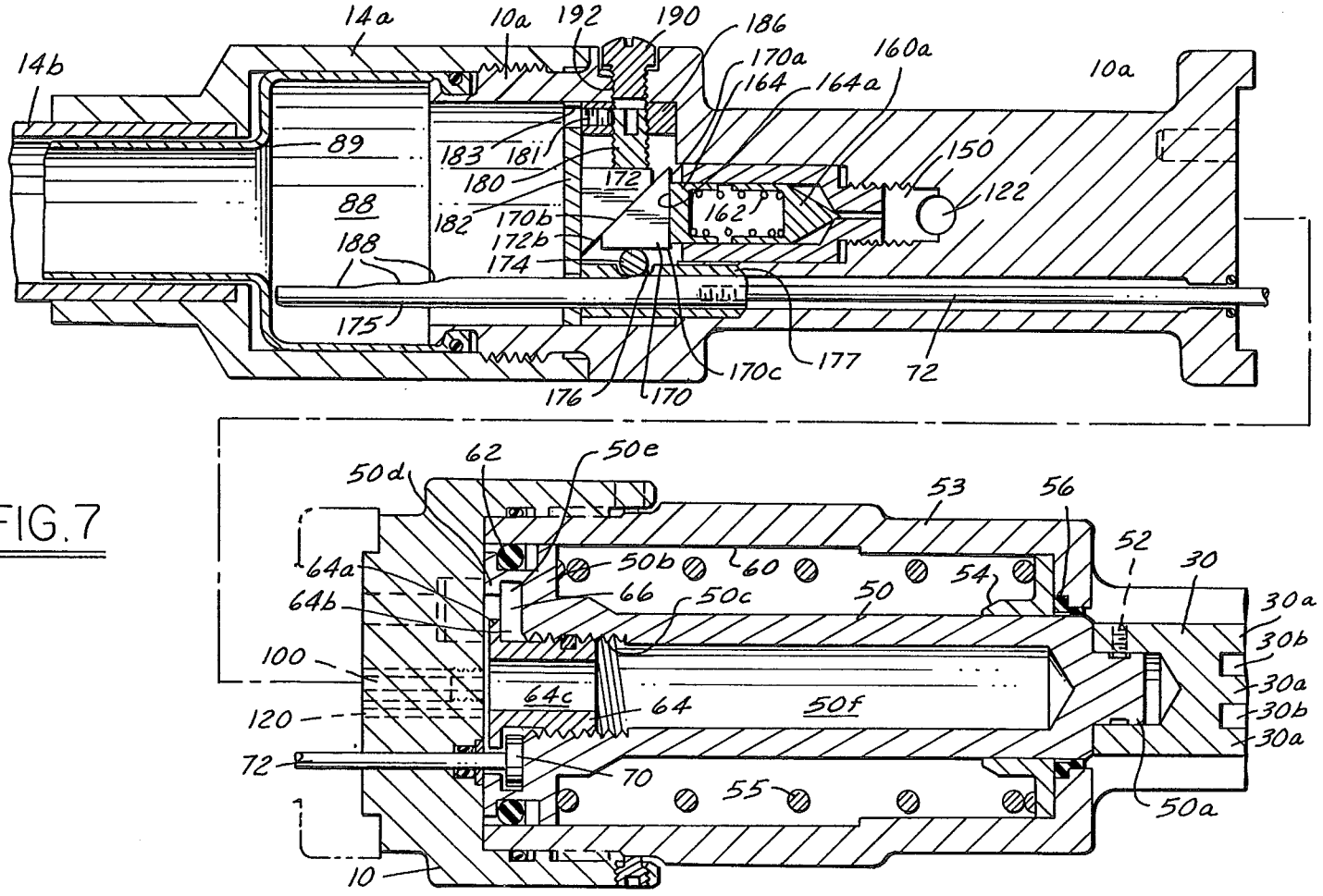
FIG. 7 is a longitudinal sectional view taken along line 7—7 of FIG. 2.

As shown best in FIG. 7, the movable jaw 30 is drivingly connected to hydraulic piston or ram 50 by set screw 52 or other connector means. Hydraulic piston 50 is a tubular member having reduced diameter outer end portion 50*a* slidably received in collar 54 in cylinder body sleeve 53 attached to main body 10 by suitable means and slidable past seal 56 and having a larger diameter flanged opposite end 50*b* which is slidably received in cylindrical bore 60 in the body sleeve 53. An o-ring seal 62 is carried on the flanged end to prevent hydraulic fluid leakage therepast. A coil spring 55 in bore 60 biases piston 50 to the left in FIG. 7 counter to pressure exerted by hydraulic fluid thereon.

The flanged opposite end 50*b* of the piston includes an inner threaded bore 50*c* in which a hollow insert 64 is threadably received. The insert includes annular flange and groove 64*a*, 64*b* which cooperate with annular flange and groove 50*d*, 50*e* of the piston to form an annular chamber 66 to receive the head 70 of follower rod 72 and pressurized hydraulic fluid.

Insert 64 includes a longitudinal bore 64*c* in fluid flow relation to the inner longitudinal bore 50*f* of piston 50, both of which bores receive hydraulic fluid.

Figure 3:
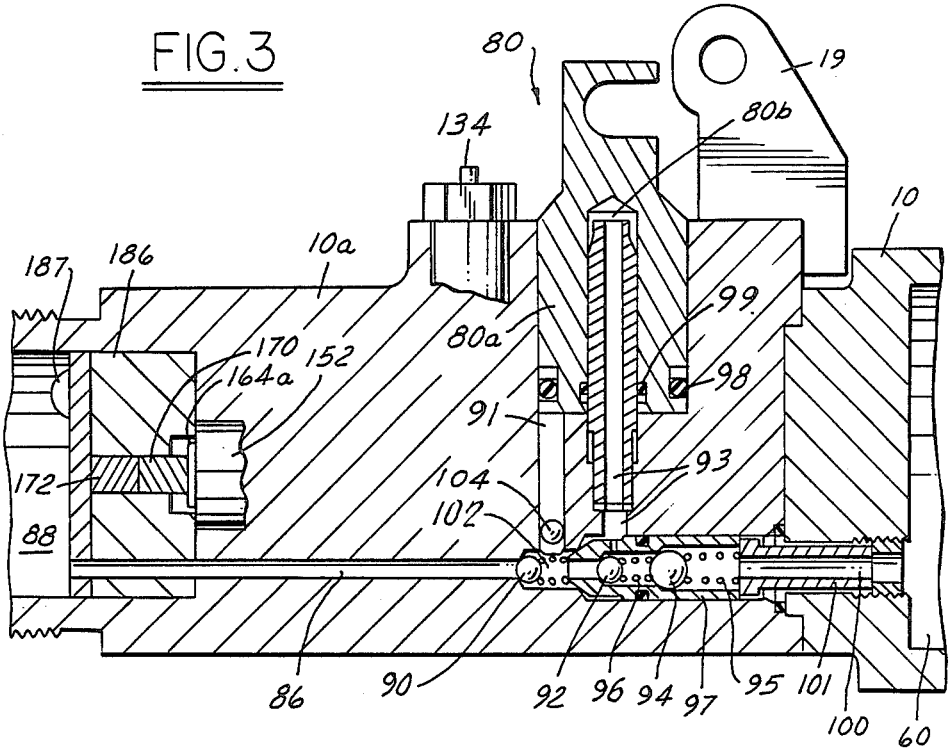
FIG. 3 is a partial longitudinal sectional view taken along line 3—3 of FIG. 1.

Piston 50 is driven by hydraulic fluid supplied from the driver plunger 80 shown best in FIG. 3. Plunger 80 is connected to movable handle 16 and directly driven thereby through pin 84. Plunger 80 includes a low pressure portion 80*a*. A fluid supply passage 86 in main body 10 connects a fluid reservoir 88 with a series of spring-biased ball check valves 90,92,94, balls 92,94 being disposed in sleeve insert 97 held in position by retainer sleeve 101. Reservoir 88 is formed inside the fixed hollow handle portion 14 in part by a rubber bladder 89 inside thereof as shown best in FIG. 7. Rubber bladder 89 is closed by a reservoir fill plug 89*a*. When plunger 80 is raised by handle 16, check valve 90 (low pressure intake valve) and check valve 92 (high pressure intake valve) open against bias of springs 102,96 to admit hydraulic fluid from reservoir 88 and passage 86 to chambers 91,93 while check valve 94 remains closed by bias of spring 95. On the initial downstroke of plunger 80, check valve 90 closes and check valve 92 which also functions as low pressure discharge valve initially opens as does check valve 94 to admit fluid from chamber 91 through valves 92 and 94 and fluid from chamber 93 through valve 94 to passage 100, which in turn supplies the pressurized fluid to chamber 66 and bore 50*f* of piston 50 to drive the piston to the right in FIGS. 2 and 7. Low pressure fluid is typically used for the most part to effect rapid and lengthy movements of the piston 50 and jaw 30 to make initial contact with an electrical connector placed between the jaws.

After jaw 30 makes contact with an electrical connector and begins to crimp same using high crimping forces (high fluid pressures), a high pressure portion 80*b* of plunger 80 assumes the pumping function to force high pressure fluid in chambers 93 past check valve 94, while both check valves 90,92 are closed, to passage 100 and hence to piston 50 along the same flow path as lower pressure fluid.

Plunger 80 carries o-ring seals 98,99 for hydraulic fluid sealing action.

Figure 6:
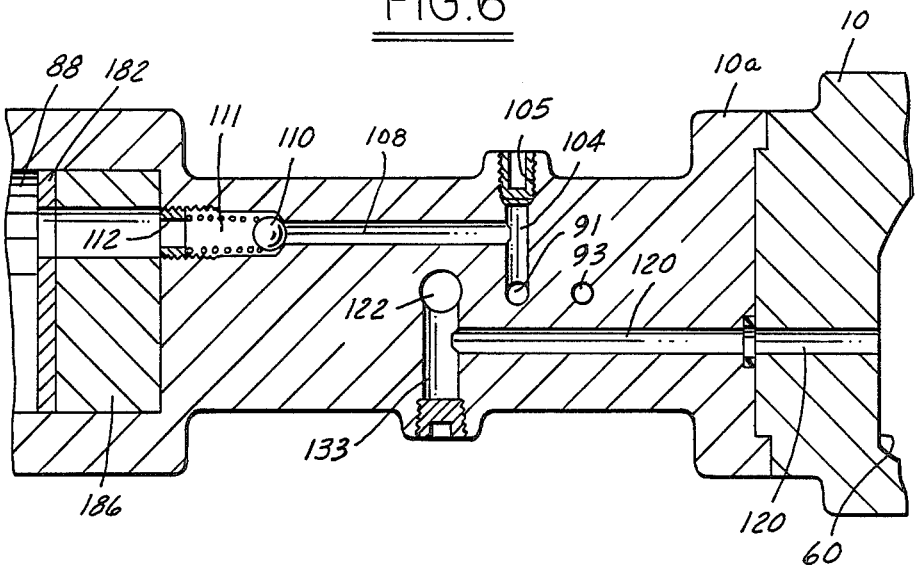
FIG. 6 is a sectional view taken along line 6—6 of FIG. 5.

A transverse passage 104 intersects chamber 91 and, as shown in FIG. 6, leads to a plugged opening 105 to the exterior and also intersects with passage 108 closed by spring-biased low pressure release ball check valve 110 and openable to reservoir 88 when check valve 110 unseats as a result of the fluid pressure exceeding a preselected maximum valve. During normal operation of the crimping tool, check valve 110 is closed by spring-bias of spring 111 held by hollow threaded plug 112.

A fluid return passage 120 extends from piston 50 through main body 10 to a transverse passage 122. A larger diameter transverse passage 124 extends from passage 122 to the top of the main body. In the larger diameter passage 124 is a sleeve insert 126 having a ball check valve 128, biasing spring 130 for valve 128, and a slidably received pressure release plunger 132 having an end 134 exterior of main body 10 for actuation by lever 136 on movable handle 16 as described below. Plunger 132 carries an o-ring hydraulic seal 138 for sealing as plunger slides within sleeve insert 126. A transverse drain passage 133 extends to the exterior of the main body and is plugged.

At the end of a crimp, the operator pulls trigger 140 on handle 16 to displace lever 136 downwardly via linkage 141. When the operator lowers handle 16 toward fixed handle 14, the lever 136 depresses release plunger 132 downwardly in sleeve insert 126 and unseats check valve 128 so that hydraulic fluid can flow back to reservoir 88 from passages 122,124 through return passages 142,144.

During the crimping operation, means is provided for automatically controllably reducing crimping force as well as the extent of crimping deformation that will be defected during crimping in dependence upon the position of piston 50 and thus the position of movable jaw 30 relative to fixed jaw 32. Decrease of crimping force and crimp deformation is selected in increments depending upon the size or ranges of sizes of electrical connectors to be crimped by the tool so that for each particular size connector or range of sizes, a selected final crimping force and amount of final crimping deformation will be effected and achieved at a final selected fully crimped condition for each size or range of sizes of connectors with the extent of crimping deformation being varied for different sizes or ranges of sizes of connectors such that the different sizes can be accommodated and crimped without over-crimping or under-crimping.

The incremental automatic crimping force reducing means includes a longitudinal passage 150 intersecting transverse passage 122 and in fluid flow relation therewith. A small diameter portion 150*a* of passage 150 is threaded and threadably receives the threaded end of hollow valve body 152 as shown. A larger diameter portion 150*b* of passage 150 receives the large diameter portion of body 152. Inside body 152, a longitudinal passage 154 extends from passage 122 to a larger diameter internal chamber 156. Within chamber 156 is a plunger valve 160 having a conical end 160*a* seated against the seat formed by passage 154 and closing passage 154 when bias from spring 162 is sufficient. A valve spring cap 164 is also located in chamber 156 and the spring 162 extends between cap 164 and plunger valve 160 as shown.

Figure 4:
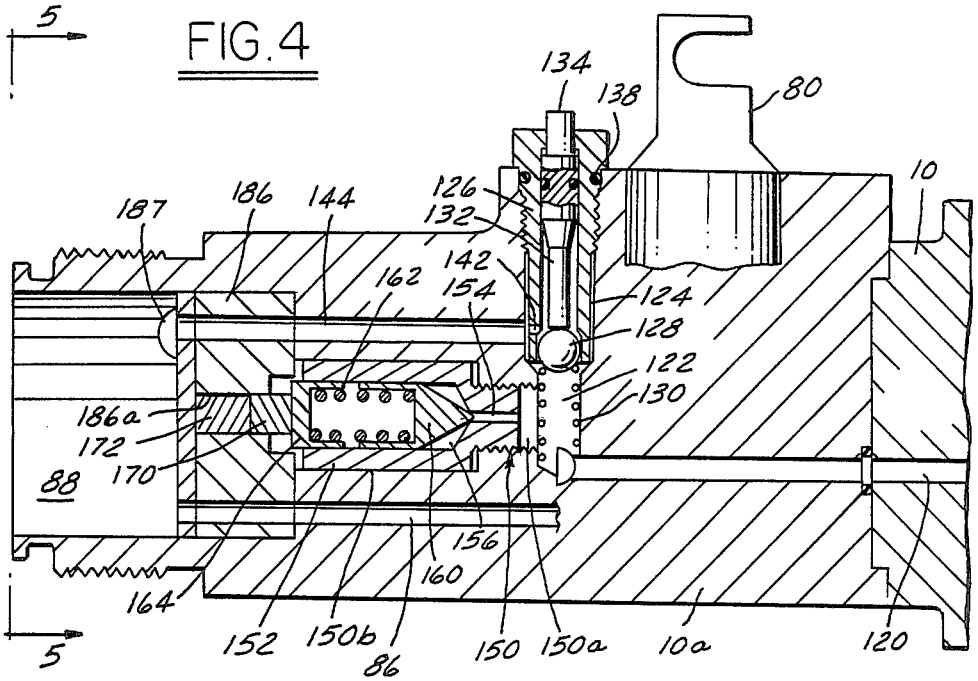
FIG. 4 is a partial longitudinal sectional view taken along line 4—4 of FIG. 1.
Figure 5:
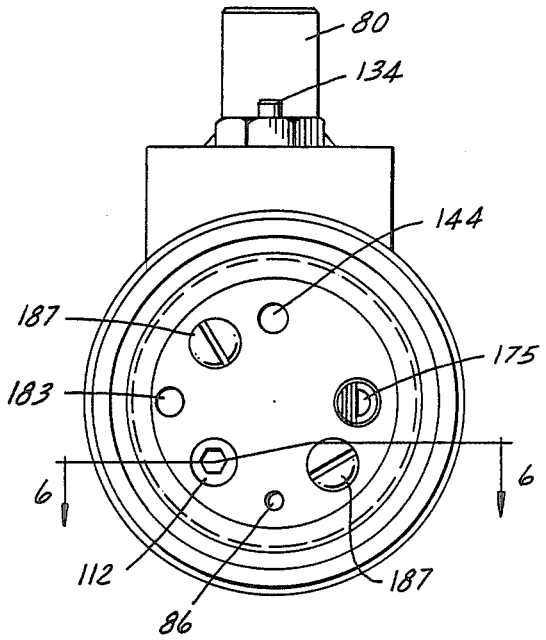
FIG. 5 is an end elevation along line 5—5 of FIG. 4.

The bias exerted by spring 162 on plunger valve 160 is incrementally decreased so that plunger valve 160 will open from its seated position shown in FIG. 4 at different incrementally controlled and reduced fluid pressures generated in the hydraulic system at a final connector crimp condition (selected final deformation of the connector) for incremental crimping force reduction purposes. This accomplished by a movable slide or wedge 170 and fixed slide or wedge 172, valve adjusting roller 174 and stepped end followed extension 175 of follower rod 72 with movable wedge 170 engaging against the cap 164 as shown.

In particular, movable slide 170 includes contact surface 170*a* which contacts end surface 164*a* of cap 164 by virtue of biasing from spring 162. Slide 170 includes inclined surface 170*b* slidably contacting a complementary inclined surface 172*b* on fixed slide 172 which is held in fixed position relative to slide 170 by socket head set screw 180 and cover plate 182 engaging surfaces of slide 172 orthogonal to one another as shown. Set screw 180 is threadably received in a threaded bore in a cap member 186 and locked in position by axial lock screw 181 accessible through hole 183. The slides 170,172 are received in a slot 186*a* in the cap member 186. The cover plate 182 is held to cap member 186 by screws 187. A fillester head screw 190 is threaded into a threaded bore 191 in main body 10 to protect the set screw 180.

The position of the movable slide 170 relative to fixed slide 172 is controlled by engagement of follower surface 170*c* of slide 170 with valve adjusting follower roller 174 which, in turn, engages and is allowed to move by the stepped end followed extension 175 of the follower rod 72 as it moves to the right (in FIG. 7) with piston 50 during a crimping operation. Roller 174 is located and guided in a slot 176 fixed in a sleeve carrier 177 positioned around extension 175 and held in axial position by cover plate 182. It is apparent that extension 175 is threadably coupled to follow rod 72 and includes multiple followed steps or surfaces 188 of different transverse spacing or distance from valve adjusting roller 174. The roller 174 is shown on the highest step 188 in FIG. 7 at the beginning of the crimping operation before piston 50 has moved. As the piston 50 moves to the right in FIG. 7, it is apparent that the other steps 188 may successively pass by the roller allowing the roller 174 to move away from slide surface 170*c*. This roller action will cause slide 170 to move along surface 170*b* from right to left in FIG. 7 decreasing bias on spring 162 in set increments. When the piston 50 and jaw 30 have moved into initial contact with an uncrimped electrical connector between the jaws, increased fluid back pressure will be generated in passage 122 and increase as crimping deformation proceeds as a result of further movement of piston 50 and jaw 30 and thus follower rod 72. When the preselected extent of connector deformation is obtained, the fluid back pressure in passage 122 will be capable of overcoming the spring bias established by that step to open valve 160 to release the crimping pressure applied by jaw 30 and end the crimping deformation at the selected extent or percentage of original connector dimension. The axial lengths of the steps 188 are selected to achieve a final crimping force as correlated with the final piston position at desired crimping deformation, for example, preselected percentage of deformation of connector outer diameter, and then release of crimping force after the preselected crimping deformation has been reached. That is, knowing the final position desired for the movable jaw 30 relative to the stationary jaw 32 and the final desired crimping pressure for each size or range of sizes of connectors, the lengths of the steps 188 can then be determined to this end. Of course, the transverse distance of the steps 188 from roller 174 is selected to decrease bias of spring 162 to levels that will provide the desired final crimiping pressure exerted on a particular size or range of sizes of connectors. It is likely that the roller 174 could be on a particular step 188 at initial contact of jaw 30 with the connector and would be on a different step at the end of crimping to relieve spring bias at a desired relief pressure. Fluid release past valve 160 flows to reservoir 88 in the clearance space around the valve 160 in valve body 152 and around cover plate 182. The crimping force exerted by piston 50 is reduced depending upon the extent of travel of piston 50 and thus movement of jaw 30 toward jaw 32. Four steps 188 are provided in FIG. 7 and thus four different sizes or ranges of sizes, such as 1000 mcm-500 mcm, of electrical connectors can be crimped with each connector being subjected to a particular individual crimping deformation determined by the particular step 188 on which the roller 174 rests at the final crimping position. Overcrimping of connectors is thus avoided.

At the end of a crimping operation on a connector, handle 16 will be lowered to cause lever 136 to depress release plunger 132 to fully relieve any residual fluid pressure on piston 50.

It is apparent in FIG. 7 that the hollow fixed handle 14 includes a first tubular portion 14*a* threadably engaged to a threaded portion of the main body extension 10*a* and a second tubular portion 14*b* extending from portion 14*a* and having its open end closed by grip 192 of handle 14 which includes a vent hole 192*a*.

It is apparent that in lieu of the multiple steps 188 shown and described hereinabove that an inclined surface of linear or curvi-linear form could also be used in the invention as the followed surface (followed by roller 174), the inclined being relative to the longitudinal axis of the follower rod extension 175.

While certain specific and preferred embodiments of the invention have been described in detail hereinabove, those skilled in the art will recognize that various modifications and changes can be made therein within the scope of the appended claims which are intended to include equivalents of such embodiments.

I claim:

1. A hydraulic crimping tool comprising:

a movable piston driven by a fluid for applying crimping force on an article to be crimped; and crimping force adjusting means including a piston follower member interconnected with said piston for directly related movement whenever said piston moves, said crimping force adjusting means being adapted to sequentially and automatically reduce the force applicable by said piston in dependence on the amount of movement from a starting position of said piston.

2. The tool of claim 1, wherein said crimping force adjusting means further includes:

relief valve means responsive to the pressure of said fluid for limiting the force of said fluid driving said piston; spring means exerting a biasing closure force on said relief valve means in opposition to said fluid pressure; and means responsive to movement of said piston follower member effecting sequential automatic reduction of the biasing closure force exerted by said spring means on said relief valve means in dependence on the amount of movement from said starting position of said piston.

3. A hydraulic crimping tool comprising:

a movable piston driven by a fluid for applying crimping force on an article to be crimped, and crimping force adjusting means which comprises a piston follower member movable with said piston, such crimping force adjusting means being adapted to sequentially and automatically reduce the force applied by said piston in dependence on the amount of movement thereof, said crimping force adjusting means further including relief valve means actuated by said piston follower member, spring means exerting a biasing closure force on said relief valve means, and means responsive to movement of said piston follower member to effect sequential automatic reduction of the biasing force exerted by said spring means on said relief valve means in dependence of the amount of movement of said piston, wherein said piston follower member has a followed surface and is connected to said piston so as to move therewith; and said crimping force adjusting means further comprises slide means in slidable contact with said spring means and further slidably coupled to said followed surface of said piston follower member; said slide means being responsive to sliding of said followed surface of said piston follower member therepast to slidably move in contact with said spring means so as to change the biasing force exerted by said spring means on said relieve valve means.

4. The tool of claim 3, wherein said slide means is slidably coupled by a roller to said followed surface of said piston follower member, said roller moving in response to said followed surface of said piston follower member therepast to cause said slide means to slidably move in contact with said spring means.

5. A hydraulic crimping tool comprising: a movable piston for applying crimping force to an article to be crimped; a fluid reservoir; valve means coupled to said piston and to said reservoir so that fluid in said reservoir exerts hydraulic pressure on said valve means in response to movement of said piston; spring means exerting a biasing closure force on said valve means in opposition to the hydraulic pressure exerted thereon by said fluids; a piston follower movable with said piston; and biasing force adjusting means operatively coupling said spring means and said piston follower so as to sequentially reduce the biasing closure force exerted by said spring means on said valve means in dependence on the amount of movement of said piston follower; whereby the hydraulic pressure for causing said valve means to open against said spring biasing closure force is sequentially reduced in correspondence with movement of said piston.

6. A hydraulic crimping tool comprising: a movable piston for applying crimping force to an article to be crimped; a fluid reservoir; valve means coupled to said piston and said reservoir, so that fluid in said reservoir exerts hydraulic pressure on said valve means in response to movement of said piston; spring means exerting a biasing closure force on said valve means in opposition to the hydraulic pressure exerted thereon by said fluids; a piston follower member having a followed surface and movable with said piston; and slide means in slidable contact with said spring means and further slidably coupled to said followed surface of said piston follower member; said slide means being responsive to sliding of said followed surface of said piston follower member therepast to sequentially reduce the spring biasing force exerted on said valve means; whereby the hydraulic pressure for causing the valve means to open against such spring biasing force is sequentially reduced in correspondence with movement of said piston.

7. A hydraulic crimping tool for crimping different sizes of electrical connectors, comprising:

a stationary crimping jaw;

a movable crimping jaw which is movable from a starting position toward the stationary crimping jaw so as to crimp an electrical connector positioned therebetween;

a movable piston coupled to the movable jaw for exerting force thereon for driving said movable jaw toward the stationary jaw; and means for automatically limiting the driving force exerted on the movable jaw by said piston in dependence upon the amount of movement from said starting position of said piston, the driving force limit diminishing to predetermined levels as said movable jaw approaches said stationary jaw, said means for limiting the driving force exerted on said piston comprises piston follower means moving in direct relationship with movement of said piston.

8. The crimping tool of claim 7, wherein said piston is driven by pressurized fluid and further comprising relief valve means for relieving said driving pressure, and spring means biasing said relief valve means closed in opposition to said pressure; said piston follower means sequentially reducing the spring bias force exerted on said valve means in dependence upon the amount of movement away from said starting position of said piston.

9. A hydraulic crimping tool for crimping different sizes of electrical connectors, comprising:

a stationary crimping jaw;

a movable crimping jaw which is movable toward the stationary crimping jaw so as to crimp an electrical connector positioned therebetween;

a movable piston coupled to the movable jaw for exerting force thereon for driving it toward the stationary jaw;

and means for automatically controlling the driving force exerted on the movable jaw by said piston and the consequent crimping deformation of said electrical connector in dependence upon the amount of movement of said piston, said means for controlling the driving force exerted on said piston comprises piston follower means movable therewith, and relief valve means and spring means biasing said relief valve means closed; said piston follower means sequentially reducing the spring bias force exerted on said valve mean in dependence upon the amount of movement of said piston, wherein said piston follower means comprises a stepped follower rod movable with said piston, the distance between the steps on such follower rod being correlated with the desired degree of crimping of said electrical connector, wherein said piston follower means further comprises slide means in sliding contact with said follower rod and in slidable contact with said spring means for reducing the spring biasing force exerted on said relief valve means in correspondence with the steps on said follower rod.

10. The crimping tool of claim 9, wherein said slide means comprises a stationary wedge and an inclined wedge in contact therewith, such inclined wedge being coupled to said follower rod and movable in response to movement therepast of the successive steps on said follower rod so as to control the spring bias force exerted by said spring means on said relief valve means on said relief valve means.

* * * * *